United States Patent [19]

Hogg

[11] Patent Number: 4,688,290

[45] Date of Patent: Aug. 25, 1987

[54] APPARATUS FOR CLEANING PIPES

[75] Inventor: George A. Hogg, Scotland, Scotland

[73] Assignee: Sonat Subsea Services (UK) Limited, Aberdeen, Scotland

[21] Appl. No.: 811,500

[22] Filed: Dec. 20, 1985

[51] Int. Cl.[4] ..... B08B 9/02
[52] U.S. Cl. ..... 15/104.04; 15/88
[58] Field of Search ..... 15/93 R, 104.04, 88

[56] References Cited

U.S. PATENT DOCUMENTS 2,782,436 2/1957 Tomer ..... 15/104.04
2,813,285 11/1957 Aslin et al. ..... 15/104.04

*Primary Examiner*—Edward L. Roberts
*Attorney, Agent, or Firm*—Ratner & Prestia

[57] ABSTRACT

Apparatus for cleaning an underwater structure such as a pipe, riser or the like, having a collar which fits around the structure and scrapers extending inwardly of the collar to engage the structure. The apparatus can be pulled along the structure by a winch and the scrapers dislodge detritus and marine growth as they move.

7 Claims, 5 Drawing Figures

APPARATUS FOR CLEANING PIPES

This invention relates to apparatus for cleaning underwater structures, for example pipes and the like.

In the offshore oil industry marine risers, pipelines and other tubular structures can become contaminated on their outer surfaces with marine growth. Such contamination increases the weight and drag of the members and can allow corrosion damage of the structures.

Previously-proposed methods of cleaning such members have involved divers working underwater to remove the growth using hand-held scraping and chipping tools, or directing high-pressure water jets against the member's surface.

According to the present invention there is provided apparatus for cleaning an underwater structure comprising a collar for fitment around a structure to be cleaned, a scraper member extending inwardly of the collar so as to engage the structure in use, resilient bias means for urging the scraper inwardly of the collar, and means for use in moving the scraper member along the structure.

Preferably more than one scraper member is provided; a series of such members may be spaced around an inner face of the apparatus. A further series of scraper members may be provided in similar fashion, the members in the further series being spaced longitudinally and offset laterally from the scraper members of the first series.

The scraper members may be generally wedge-shaped with the leading edge forming a cutter for engaging a pipe at a suitable angle to remove marine growth as it travels along the underwater structure. The material of the scraper members may be selected according to the nature of the marine growth to be removed and the material of the structure, and may range from plastics material such as Nylon to metal such as hardened steel.

The resilient bias means is preferably a spring, for example a leaf spring secured at one end to the collar and at its other end to the scraper member. The connection to the scraper member may be shearable so that if the member engages in use with a fixed projection on the structure being cleaned it shears off instead of damaging the structure.

The collar is preferably split longitudinally for fitment around a structure, the portions being hinged together for easy fixing.

The means for use in moving the scraper member along the structure may be for example one or more pulleys around which passes a cable or other flexible connector. The cable may be connected to a winch at the top of the structure, actuation of the winch drawing in the cable and pulling the apparatus upwardly along the structure.

Preferably means are provided for centering the collar around the structure; this may be in the form of wheels or rollers mounted on and disposed around the collar and extending inwardly of it so as to run on the surface of the structure.

Embodiments of this invention will now be described by way of example with reference to the accompanying drawings in which.

Figure 1:
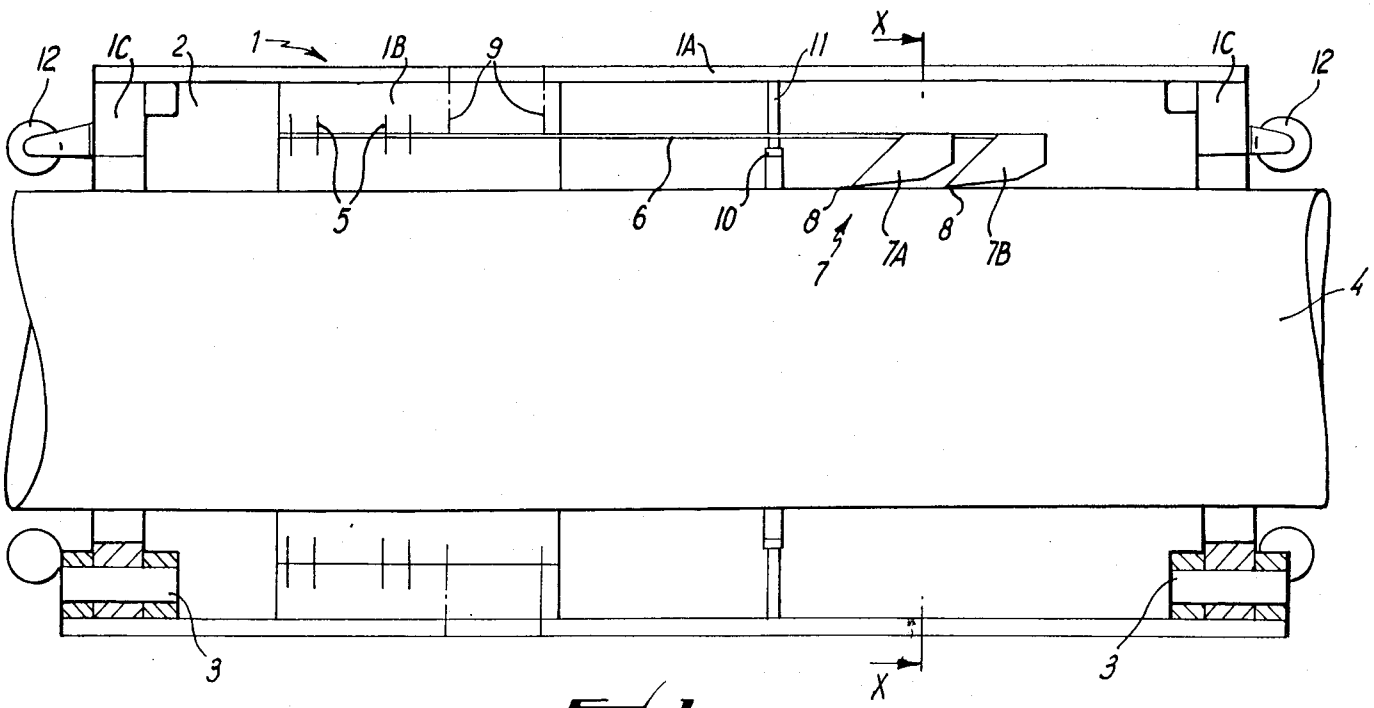
FIG. 1 is a side part-sectional view of apparatus of this invention in use.
Figure 2:
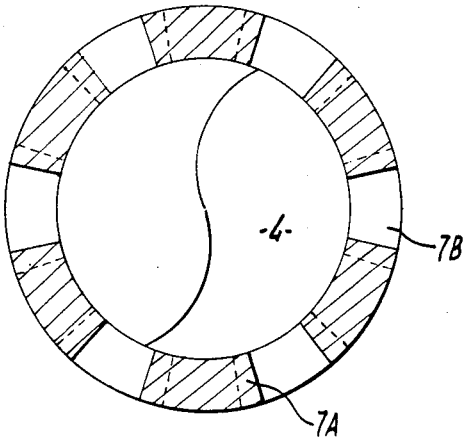
FIG. 2 is an end sectional view on X—X of FIG. 1 with the springs and collar omitted.
Figure 3:
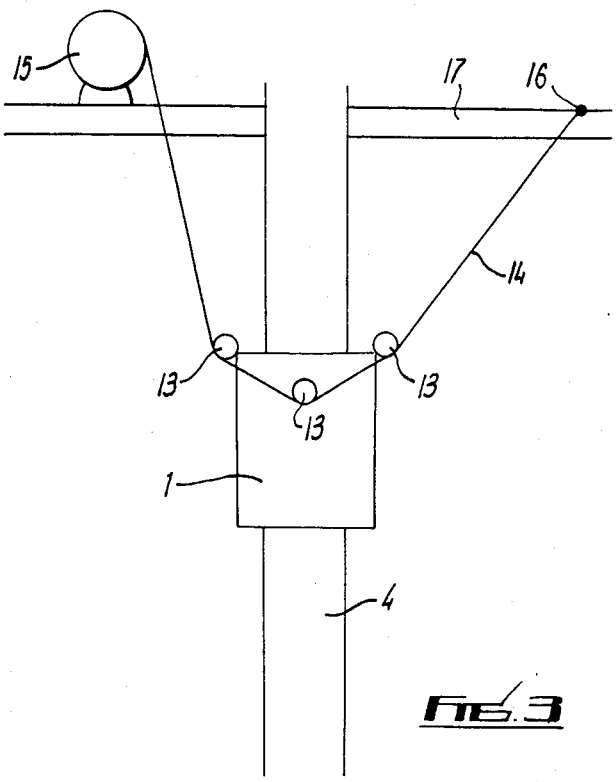
FIG. 3 is a schematic side view showing the apparatus of FIG. 1 in use.

Referring now to the drawings, the apparatus of the embodiment of the invention shown in FIGS. 1, 2, and 3 has a cylindrical collar 1 which is split into two semi-cylindrical portions 2 interconnected by hinges 3. The collar 1 is of sufficient internal diameter to envelope a marine riser 4 to be cleaned, with a clearance between them, and consists of outer connecting bars 1A with annular carriers 1B, 1C secured to their inner face.

The carrier 1B has bolted to it at 5 six leaf springs 6 equispaced around it, and the free end of each leaf spring 6 has bolted to it by brass bolts a scraper block 7. The scraper blocks 7 in this embodiment are of Nylon 66 and are arranged in two annular rows 7A and 7B. The blocks 7B are spaced axially of the collar 1 from the blocks 7A, and are offset circumferentially of the blocks 7A so that, as can be seen from FIG. 2, the blocks 7A and 7B together provide effective scraping faces around the entire pipe circumference. The blocks 7A and 7B, indeed, overlap when in use on the riser 4 in this example.

Each scraper block 7 is generally wedge-shaped and presents a cutting edge 8 at a shallow angle to the surface of the riser 4.

The leaf springs 6 bias the scraper blocks 7 towards the riser 4, and adjustment screws 9 through the outer shell 1A abut against the springs 6 to increase or decrease the biasing force exerted on the scraper blocks 7.

A limit ring 10 is suspended on support posts 11 extending inwardly from the shell 1A between the leaf springs 6 in order to limit the extent of inward movement of the springs 6 in the event of one or more of the scraper blocks 7 gouging into the wall of the riser 4.

Limit rollers 12 are provided on the carriers 1C at each end of the collar 1. These rollers 12 are of plastics material and are arranged to engage the riser 4 in preference to the steel carriers 1B, 1C so as to prevent metal-to-metal contact which could damage the riser 4.

As shown in FIG. 3, guide rollers 13 (not shown in FIGS. 1 and 2) are provided at an end portion of the collar 1.

In use, where the riser 4 extends downwardly from an oil platform 17, the collar 1 is opened about its hinges 3 and around the riser 4 at deck level. The collar portions 2 are then secured together by bolts or over-centre clamps (not shown) so that it envelopes the riser 4. A wire 14 is fed around the guide rollers 13 from a winch 15 and secured to a fixture 16 on the platform 17. The winch 15 is actuated to feed out the wire 14, allowing the apparatus to move downwardly on the riser 4, the only contact with the riser wall being through the scraper blocks 7 which centre the collar 1 around the riser 4 by virtue of the leaf springs 6. As the apparatus moves down the riser 4 the scraper blocks 7 ride over marine growth easily due to their chamfered faces.

When the apparatus is below the area of the riser to be cleaned, the winch 15 is reversed to retract the wire 14 and pull the apparatus upwardly. The leaf springs 6 urge the cutting edges 8 of the scraper blocks 7 against the riser 4, cutting through and removing marine growth.

On finishing, the apparatus is returned to the platform deck where it is removed from the riser 4 by unclamping the collar portions 2.

The segmental arrangement of the scraper blocks 7 and the adjustable leaf springs 6 allows the apparatus to be used on risers, pipes and tubulars of different diameters.

Figure 4:
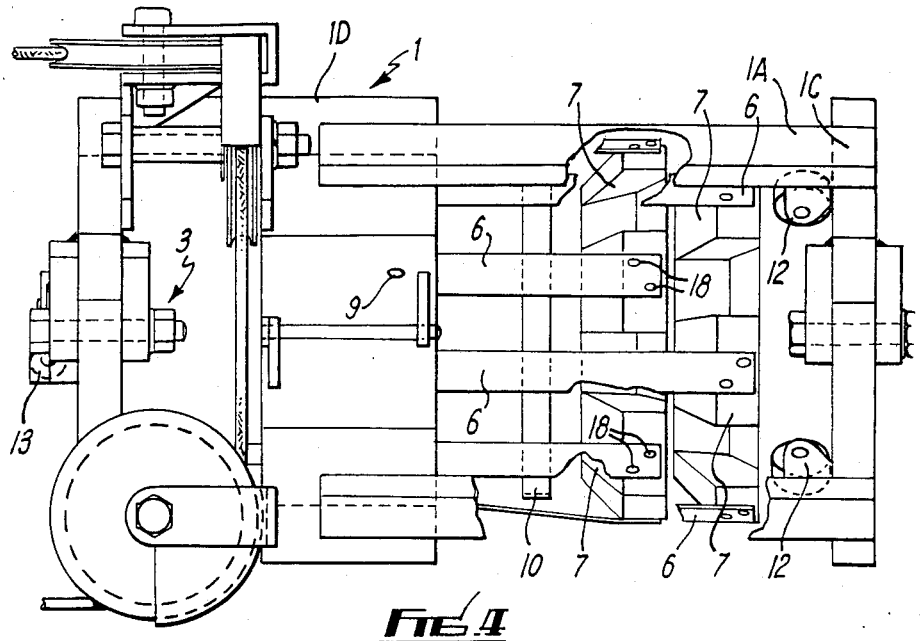
FIG. 4 is a side part-sectional view of an alternative form of the apparatus of this invention.
Figure 5:
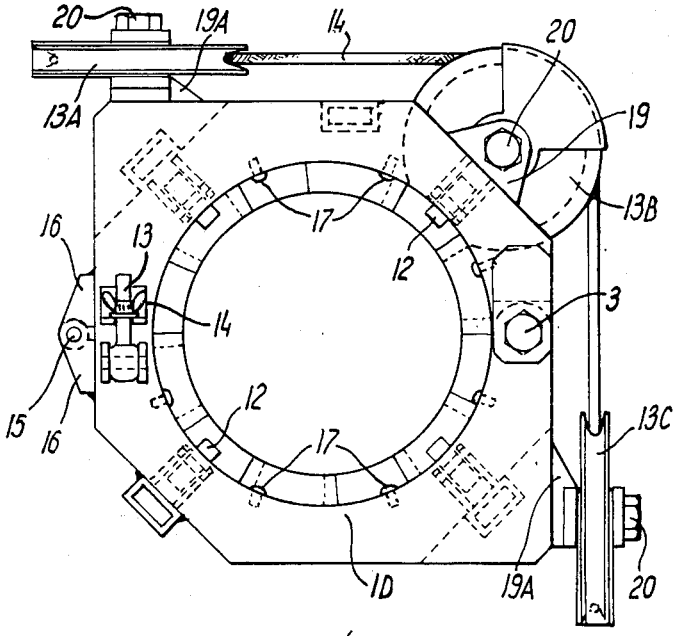
FIG. 5 is an end view of the apparatus of FIG. 4 with the scrapers removed.

Referring now to FIGS. 4 and 5, the apparatus of this embodiment is generally similar to that of FIGS. 1, 2 and 3, and equivalent parts will be identified by the same reference numerals. In FIGS. 4 and 5 the collar 1 is made up of axially-spaced rings 1C, 1D which are interconnected by circumferentially-spaced connecting bars 1A. The bars 1A and rings 1C, 1D are bolted together so as to be demountable. The rings 1C, 1D are hinged at 3 to form semi-cylindrical portions and lockable by a toggle bolt 13 on one portion which engages with and is tightened against a bracket 14 on the other portion. A securing pin 15 is also inserted through correspondingly-apertured brackets 16 on the two portions as additional fixing. Anti-scuff buttons 17 protrude inwardly of the collar 1 to reduce frictional damage between the pipe to be cleaned and the collar 1.

In this case the limit rollers 12 are provided only on the ring 1C and are inwardly-directed as shown in FIG. 4, and the plastics scraper blocks 7 are secured to their leaf springs 6 by shearable brass bolts 18.

At the end of the apparatus which is closest to the winch in use, three pulleys 13A, 13B and 13C are mounted on the ring 1D around its periphery, and the wire 14 passes around them between the winch 15 and fixed point 16 as shown in FIG. 3. The pulleys 13A, 13B and 13C are rotatable on bolted axles 20 which are held on brackets 19. The brackets 19A for the pulleys 13A and 13C are pivotally mounted on the ring 1D so as to pivot freely in bearings about the axis of the wire 14 where it extends between the pulleys 13A and 13B, and 13B and 13C respectively. This allows the pulleys to pivot when the winch is actuated, so as to adopt the most effective position for passage of the wire 14; this is especially useful when the apparatus is near the top of its travel, and the wire 14 forms a very large angle between the sections leaving the pulley 13A and the pulley 13C.

In use, the apparatus of FIGS. 4 and 5 operates in the same manner as that of FIGS. 1, 2 and 3.

Various modifications can be made to the apparatus of these embodiments. For example the limit ring 10 can be dispensed with and replaced by projecting buttons secured on the inwardly-directed face of the leaf springs 6, the buttons engaging the riser's outer face if the springs 6 deflect towards the riser beyond a predetermined desired extent. In the event of a scraper block 7 engaging an immovable obstruction on a riser, the wedge shape of the block 7 causes it to rotate about the obstruction and bend the leaf spring 6 towards the riser along its length. When the button engages the riser, further rotation is prevented and the scraper block will either ride over the obstruction or shear its brass retaining bolts 18; the apparatus then is free to continue.

Further, the ring 1D of FIG. 4 may be replaced by a pair of axially-spaced rings which are interconnected by extensions to the bars 1A. Each ring has its inwardly-directed face inclined inwardly towards the ring 1C, and the leaf springs 6 are secured to these inclined faces. The inclination directs the springs 6 towards the riser in use and can obviate the need for the adjustment screws 9 in the illustrated embodiments. The ring which is furthest from the winch may be grooved to allow free passage of the leaf springs secured to the other ring.

A camera array may be provided on the apparatus to observe the cleaning effect, and spring-loaded rollers may be provided to engage the riser surface and centre the apparatus.

I claim:

1. Apparatus for cleaning an underwater structure comprising:

a tubular member to be cleaned;

a collar extending around said tubular member;

a scraper member extending inwardly of said collar; resilient bias means for urging the scraper member into contact with a surface of the tubular member;

and means for moving the scraper member along the tubular member;

wherein the scraper member is wedge shaped and contacts the tubular member at an acute angle of attack.

2. Apparatus according to claim 1, wherein a plurality of circumferentially-spaced scraper members are provided.

3. Apparatus according to claim 2, wherein the scraper members are circumferentially-spaced and axially-spaced.

4. Apparatus according to claim 3, wherein the axially-spaced scraper members are offset so as to overlap circumferentially.

5. Apparatus according to claim 1, wherein the resilient bias means is a leaf spring extending from the collar and the scraper member is secured to said leaf spring, the spring biassing the scraper member inwardly of the collar.

6. Apparatus according to claim 1, wherein the collar is formed by part-cylindrical sections which are mutually hinged, and releasable locking means are provided to retain the sections together in annular form.

7. Apparatus according to claim 1, wherein the means for moving the scraper member includes a winch for attachment to the structure and flexible connecting means which passes around the winch and round a pulley on the collar, and wherein the pulley is pivotally mounted on the collar.

* * * * *